US005843269A

United States Patent [19]

Aaron et al.

[11] Patent Number: 5,843,269

[45] Date of Patent: Dec. 1, 1998

[54] SLURRY DISPENSING SYSTEM FOR CHEMICAL-MECHANICAL POLISHING APPARATUS

[75] Inventors: Jack Aaron, Tustin; William Yueh, Irvine, both of Calif.

[73] Assignee: IC Mic-Process, Inc., Santa Ana, Calif.

[21] Appl. No.: 845,077

[22] Filed: Apr. 18, 1997

[51] Int. Cl.[6] ..... B44C 1/22

[52] U.S. Cl. ..... 156/345; 216/88; 438/692

[58] Field of Search ..... 438/691, 692, 438/745, 747, 748; 216/2, 38, 88; 156/345 LP

[56] References Cited

U.S. PATENT DOCUMENTS 4,600,469 7/1986 Fusco et al. ..... 156/345 X 5,593,537 1/1997 Cote et al. ..... 156/645 X

*Primary Examiner*—William Powell

*Attorney, Agent, or Firm*—Herbert M. Shapiro

[57] ABSTRACT

Chemical-mechanical polishing apparatus includes three subassemblies, a top subassembly which is non-rotating but which has a lower section which forms a shell about a center and a lower subassembly both of which rotate within the shell. The system also includes a slurry dispensing system which is embedded in the shell and which is operative to supply slurry just in front of the advancing edge of a wafer being polished by the system. The slurry dispensing system includes a tube with holes arranged 180 degrees about the shell of the non-rotating subassembly which is also operative to retain the wafer in contact with the (rotating) pad covered platen with which it is in contact.

3 Claims, 2 Drawing Sheets

SLURRY DISPENSING SYSTEM FOR CHEMICAL-MECHANICAL POLISHING APPARATUS

FIELD OF THE INVENTION

This invention relates to chemical-mechanical polishing apparatus and, more particularly, to slurry dispensing systems for such apparatus.

BACKGROUND OF THE INVENTION

Chemical-mechanical polishing (CMP) apparatus is in widespread use in industry. Characteristic of such apparatus is a platen rotating about a central axis and having a polishing pad attached to it's top surface. A wafer carrier lowers a wafer into contact with the rotating pad. The wafer is rotated about it's own axis and polishing occurs in the presence of a slurry introduced to the pad to facilitate the polishing. A second pressure ring outside the wafer guard is used to level off the pad surface of the polishing area for improving the uniformity and planarity of the process. The drawback to the use of a wafer guard is that it cuts off the slurry flow along the oncoming pad.

Copending application Ser. No. 08/840,250 filed Apr. 14, 1997 discloses a CMP polishing head which has three mating subassemblies where the center and bottom subassemblies rotate with respect to the top subassembly. The top of the bottom subassembly and the bottom of the center subassembly have mating surfaces where the top of the bottom subassembly varies in a manner such that the bottom subassembly is characterized by a mass which decreases incrementally with distance from the central axis thereof.

The bottom subassembly rotates within a non-rotating shell, characterized as the outside pressure ring, defined by the lower section of the top subassembly.

BRIEF DESCRIPTION OF THE INVENTION

In accordance with the principles of this invention, a slurry inlet tube is connected to the above noted shell and extends 180 degrees around the forward edge of the shell in advance of the wafer. The tube contains apertures for dispensing slurry in the path of the advancing wafer.

DETAILED DESCRIPTION OF AN ILLUSTRATIVE EMBODIMENT OF THIS INVENTION

Figure 1:
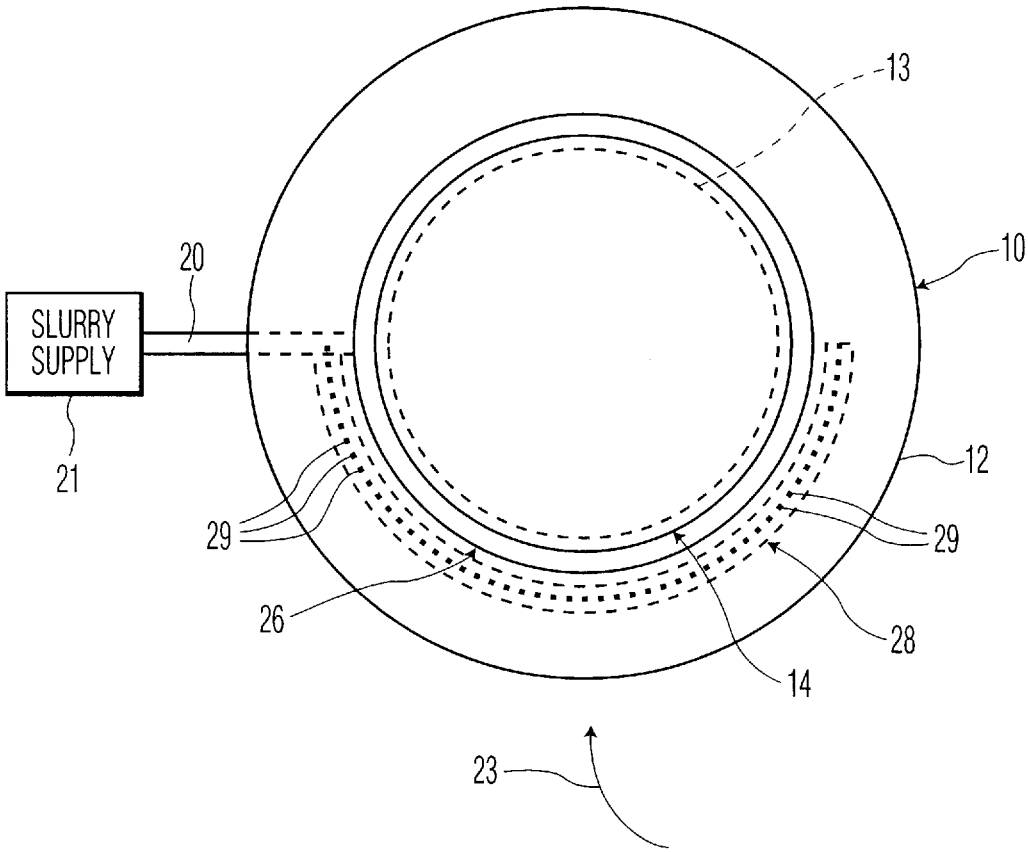
FIG. 1 shows a schematic top view of a slurry dispensing system in accordance with the principles of this invention.

FIG. 1 shows a schematic top view of a wafer carrier 10. The carrier includes three subassemblies 12, 13, and 14 partially shown in FIG. 2. Subassembly 12 is the top subassembly but includes a lower section 15 which encompasses subassemblies 13 and 14 forming a non-rotating shell around subassemblies 13 and 14. Subassemblies 13 and 14 rotate within the non-rotating shell 15.

A wafer is secured (by vacuum) to subassembly 14 and is held in place by circular lip 16. The wafer is designated 17 in FIG. 2.

Figure 2:
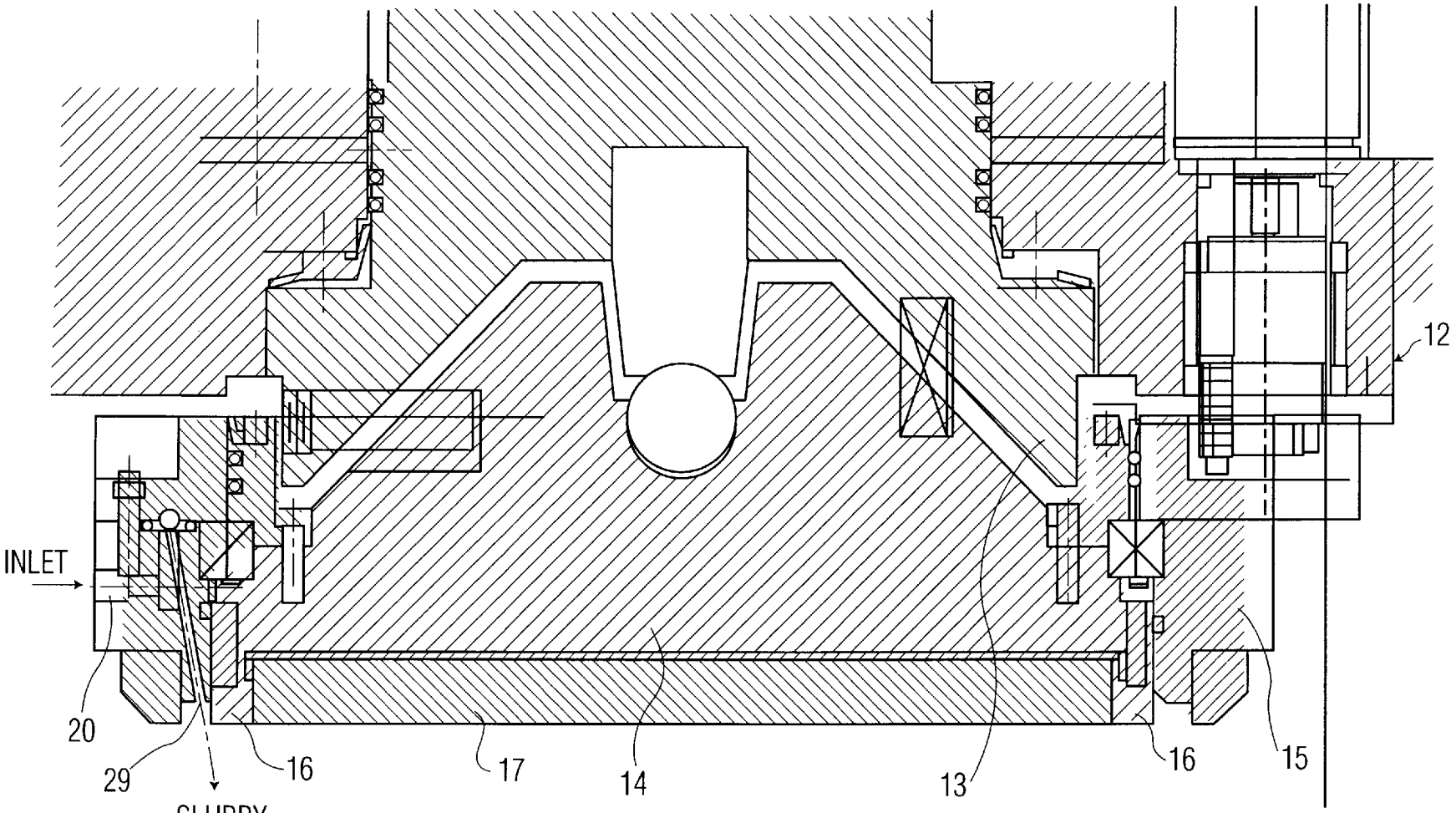
FIG. 2 is a cross section of a portion of a wafer carrier for a CMP apparatus in accordance with the principles of this invention.

FIG. 2 also shows a slurry inlet tube 20 which extends from a slurry supply designated 21 in FIG. 1. The slurry inlet tube extends 180 degrees around the advancing edge of wafer 17. If we accept the assumption that the polishing surface of the CMP apparatus is rotating clockwise, the direction of movement of the polishing surface can be represented by curved arrow 23 in FIG. 1 and the advancing edge of the wafer, accordingly, faces into the arrow (downward as viewed) and is designated 26 in FIG. 1.

The 180 degree slurry dispensing tube is represented by broken lines 28 and include apertures 29 for dispensing slurry just ahead of the advancing wafer. The apertures are also represented in FIG. 2 where the representative aperture also bears the legend "slurry out".

The dispensing of the slurry at the leading edge of the wafer ensures just in time dispensing of the slurry. The use of the familiar outer pressure ring (not shown) may be operative to depress the pad fibers also just in advance of the wafer to ensure against excessive polishing of the wafer leading edge.

The dispensed slurry can be captured and recycled as described in copending application Ser. No. 08/833,444 filed Apr. 7, 1997, now U.S. Pat. No. 5,791,970, preferably under the control of the end point detection system described in copending application Ser. No. 08/800,769 filed Feb. 14, 1997.

What is claimed is:

1. A slurry dispensing system for a chemical-mechanical polishing apparatus which includes a wafer carrier having a non-rotating subassembly and a rotating wafer holder, said non-rotating subassembly including a section which forms a shell about said rotating wafer holder, said non-rotating subassembly having therein a slurry dispensing tube, said tube extending about at least a portion of said rotating wafer holder, said tube having apertures therein for dispensing slurry, said portion being positioned at the advancing edge of a wafer being held by said wafer holder.

2. A system as in claim 1 wherein said tube extends about 180 degrees around said rotating wafer holder.

3. A system as in claim 1 also including a source of slurry connected to an inlet end of said tube.

* * * * *